US007266968B2

(12) United States Patent
Huang

(10) Patent No.: US 7,266,968 B2
(45) **Date of Patent: *Sep. 11, 2007**

(54) AIR CONDITIONER HAVING WATER DRAINING DEVICE

(76) Inventor: Chin Piao Huang, No. 40, Chisin Road, Baidon Li, Tonsiao Town, Miauli Hsien 35742 (TW)

( * ) Notice: Subject to any disclaimer, the term of this patent is extended or adjusted under 35 U.S.C. 154(b) by 193 days.

This patent is subject to a terminal disclaimer.

(21) Appl. No.: 11/147,132

(22) Filed: Jun. 7, 2005

(65) Prior Publication Data

US 2006/0272346 A1 Dec. 7, 2006

(51) Int. Cl.
*F25D 21/14* (2006.01)

(52) U.S. Cl. ..... 62/285; 62/288

(58) Field of Classification Search ..... 62/171, 62/183, 272, 279, 280, 285, 288, 289, 291
See application file for complete search history.

(56) References Cited

U.S. PATENT DOCUMENTS 3,635,046 A * 1/1972 Sato et al. ..... 62/305
6,070,423 A * 6/2000 Hebert ..... 62/277
6,318,108 B1 * 11/2001 Holstein et al. ..... 62/279
6,477,854 B2 * 11/2002 Chung et al. ..... 62/280
6,666,038 B1 * 12/2003 Hynes ..... 62/171
7,150,161 B2 * 12/2006 Huang ..... 62/279
2006/0010897 A1 * 1/2006 Huang ..... 62/279

FOREIGN PATENT DOCUMENTS

JP 56-161870 A * 12/1981

* cited by examiner

*Primary Examiner*—Mohammad M. Ali
(74) *Attorney, Agent, or Firm*—Charles E. Baxley

(57) ABSTRACT

An air conditioner includes an indoor device having a water draining hose for receiving water generated in the indoor device, an outdoor device having a fan device spindle, and a water draining device coupled to the spindle of the fan device, and coupled to the hose of the indoor device, to draw the water out of the indoor device, and to prevent the water from dropping from the indoor device. The water draining device includes a housing having a cap which includes an inlet coupled to the hose of the indoor device, and an outlet for discharging the water. The housing includes two check valves to control the water to flow from the hose of the indoor device into the cap, and then to flow out through the outlet of the cap.

12 Claims, 9 Drawing Sheets

AIR CONDITIONER HAVING WATER DRAINING DEVICE

BACKGROUND OF THE INVENTION

1. Field of the Invention

The present invention relates to an air conditioner, and more particularly to an air conditioner having a draining device for draining water from indoor device of the air conditioner, and for preventing the water from dropping from the indoor device.

2. Description of the Prior Art

Typical air conditioners comprise an outdoor device for being disposed outdoors, and for generating cooling air, and an indoor device coupled to the outdoor device, for receiving the cooling air, and for allowing the cooling air to flow or to blow into the family buildings.

Normally, when the cooling air flows or blows into the family buildings via the indoor device, a condense water may be generated in the indoor device, and may drop into the family buildings.

However, till now, the indoor device is directly coupled to the outdoor device, and the typical air conditioners do not have any water draining devices provided to remove or to drain the water that may be generated in the indoor device, such that the condense water may still drop into the family buildings and may dirt various objects in the family buildings.

The present invention has arisen to mitigate and/or obviate the afore-described disadvantages of the conventional air conditioner facilities.

SUMMARY OF THE INVENTION

The primary objective of the present invention is to provide an air conditioner including a draining device for draining or removing water from indoor devices and for preventing water from dropping into family buildings from the indoor devices.

In accordance with one aspect of the invention, there is provided an air conditioner comprising an indoor device including a water draining hose for receiving water generated in the indoor device, an outdoor device including a fan device having a spindle, and a water draining device coupled to the spindle of the fan device, and coupled to the hose of the indoor device, to draw the water out of the hose of the indoor device, and to prevent the water from dropping from the indoor device.

The water draining device includes a housing having a cap attached thereto, the cap includes an inlet coupled to the hose of the indoor device, and an outlet for discharging the water. The housing includes a compartment formed therein and communicating with the inlet and the outlet of the cap, and two check valves disposed between the compartment of the housing and the cap, to control the water to flow from the hose of the indoor device into the inlet of the cap, and then to flow into the compartment of the housing, and then to force the water to flow from the compartment to the outlet of the cap.

The water draining device includes a board secured between the housing and the cap, and having at least one orifice formed therein and communicating between the compartment and the inlet of the cap, and having at least one aperture formed therein and communicating between the compartment and the outlet of the cap, the check valves are attached to the board.

The water draining device includes a collecting reservoir coupled to the outlet of the cap, to receive and to collect the water from the water draining device. The water draining device includes a housing having a chamber formed therein, an eccentric member disposed in the chamber of the housing and having a bore formed therein for attaching to the spindle of the fan device, and to allow the eccentric member to be rotated and driven by the spindle of the fan device.

The water draining device includes a membrane device attached to the housing, and coupled to the eccentric member with a link, to allow the membrane device to be operated by the spindle of the fan device. The membrane device includes two membrane members superposed with each other and having an outer peripheral portion secured to the housing, and a follower disposed between the membrane members, and coupled to the link, to allow the membrane members of the membrane device to be actuated by the link.

The link includes an opening formed therein for rotatably receiving the eccentric member, and a bearing engaged in the opening of the link and engaged between the link and the eccentric member, for rotatably engaging the eccentric member within the opening of the link.

The indoor device includes a container, and a tray disposed in the container, to collect water, the tray includes an outlet coupled to the hose via a tube. The indoor device includes a piping disposed in the container, and arranged above the tray, to allow the tray to collect the water from the piping. The indoor device may further include a controller disposed between the tube and the hose, to control the water to flow from the indoor device to the water draining device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
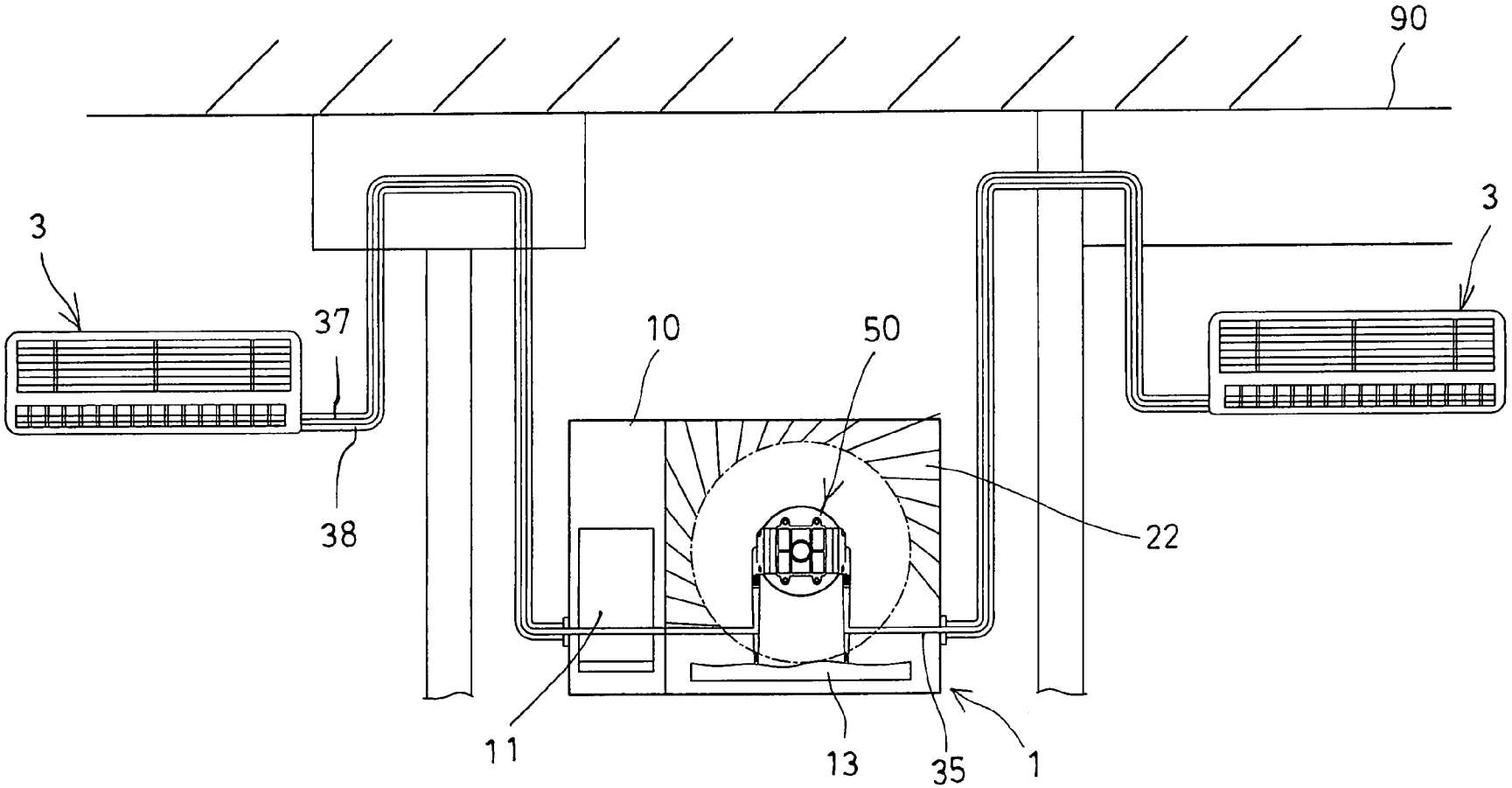
FIG. 1 is a plan schematic view of an air conditioner in accordance with the present invention.
Figure 2:
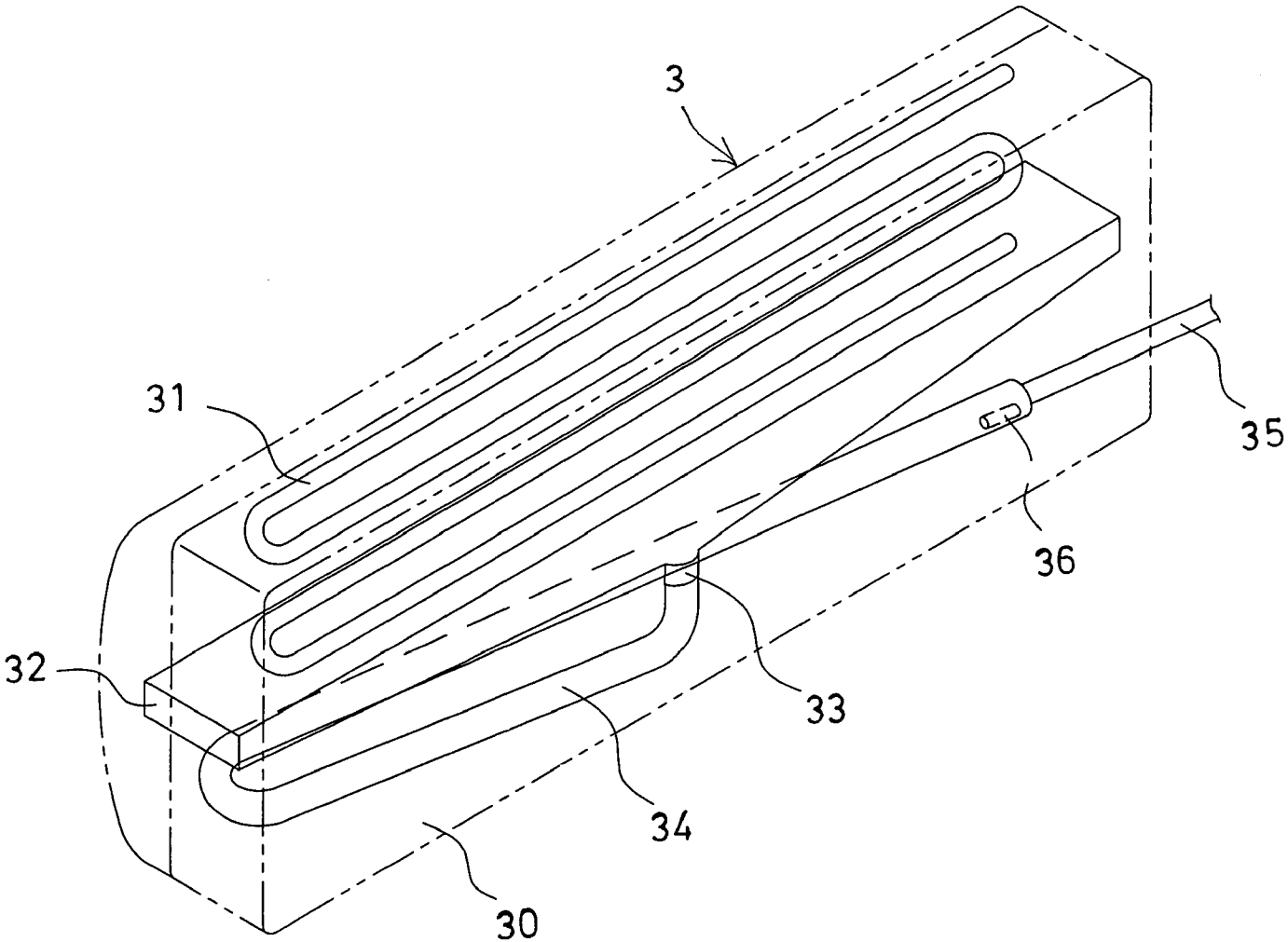
FIG. 2 is an enlarged partial perspective view illustrating the inner structure of an indoor device of the air conditioner.
Figure 3:
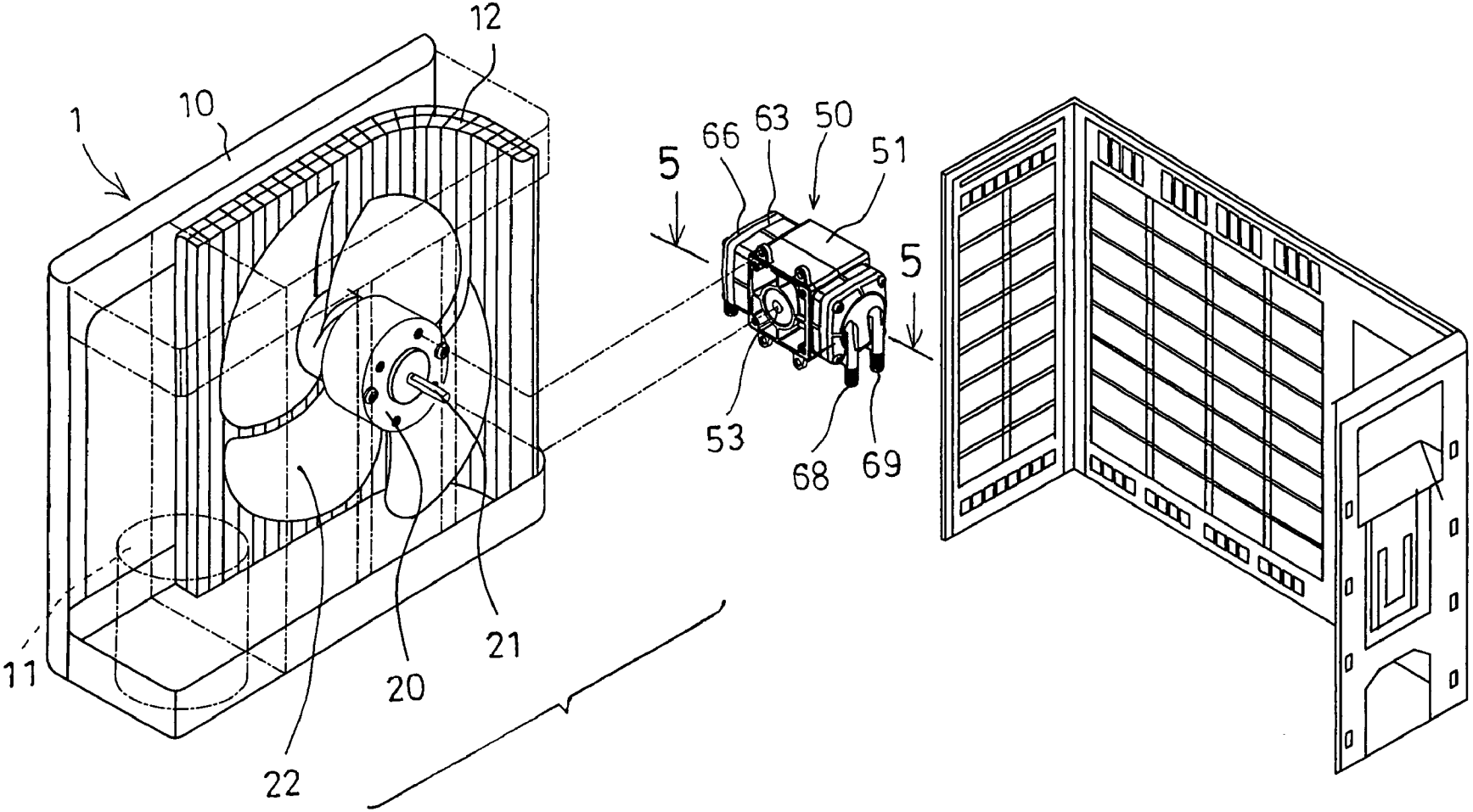
FIG. 3 is a partial exploded view of an outdoor device of the air conditioner.
Figure 4:
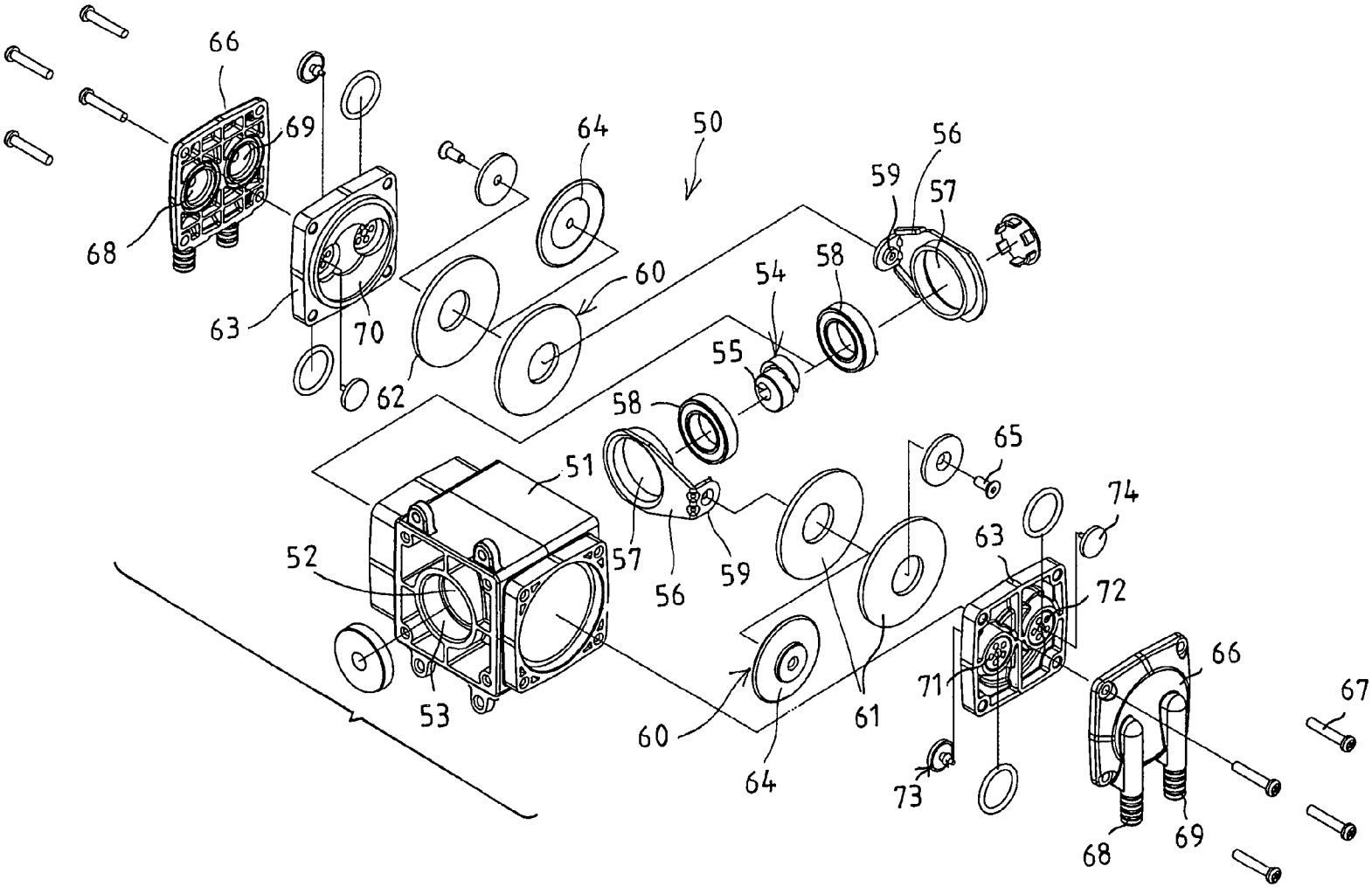
FIG. 4 is another partial exploded view illustrating the water draining device of the air conditioner.

Referring to the drawings, and initially to FIGS. 1-3, an air conditioner in accordance with the present invention comprises an outdoor device 1 for being disposed outdoors, or for being disposed out of a wall 90 of family buildings, and for generating cooling air, and one or more indoor devices 3 coupled to the outdoor device 1, for receiving the cooling air from the outdoor device 1, and for allowing the cooling air to flow or to blow into various housings of the family buildings.

As best shown in FIG. 2, illustrated is an indoor device 3 which includes a container 30, a piping 31 received or disposed in upper portion of the container 30 for such as evaporating purposes, a tray 32 disposed in intermediate portion of the container 30, and arranged below the piping 31, for collecting water that may be dropped from the piping 31. The tray 32 includes an outlet 33 formed in bottom thereof for coupling to a tube 34.

A water draining hose 35 may further be provided and coupled to the tube 34, and coupled to a water draining device 50 that is disposed in an outer receptacle 10 of the outdoor device 1, for allowing the water generated in the indoor device 3 and collected in the tray 32 from the piping 31 to flow into the water draining device 50 of the receptacle 10. Certainly, the water draining device 50 may also be disposed outside the receptacle 10, when required. A sensor or a controller 36 may be disposed in the tube 34 or the hose 35, or between the tube 34 and the hose 35, to control the water to flow to the water draining device 50 through the hose 35.

As shown in FIG. 3, the outdoor device 1 includes a receptacle 10 having a compressor 11 disposed therein, and includes a typical heater or evaporator or heat exchanging device 12 coupler thereto for heat exchanging purposes. The air conditioner may further include two hoses 37, 38 coupled between the outdoor device 1 and the indoor device 3, such as coupled between the compressor 11 of the outdoor device 1 and the piping 31 of the indoor device 3, for allowing coolant or the like to flow between the outdoor device 1 and the indoor device 3.

A motor 20 is attached or secured in the receptacle 10, and includes a spindle 21 to which a fan device 22 is attached. The fan device 22 may be used to blow or to dry the water. It is preferable that the fan device 22 is disposed or located behind the heat exchanging device 12, for agitating or for blowing the air through the heat exchanging device 12, and thus for heat dissipating purposes, for example.

Referring to FIGS. 3-7, the water draining device 50 may be disposed within or outside the receptacle 10, and may be coupled between the outdoor device 1 and the indoor device 3, or coupled to the hose 35 of the indoor device 3, and coupled to the spindle 21 of the fan device 22 which may force or pump the water from the indoor device 3 into a collecting reservoir 13 that may be received or disposed in the bottom portion of the receptacle 10 of the outdoor device 1.

The water draining device 50 includes a housing 51 having a chamber 52 formed therein, and having channel 53 formed therein and communicating with the chamber 52 thereof, to slidably receive the spindle 21 of the fan device 22, and to allow the spindle 21 of the fan device 22 to extend into the chamber 52 of the housing 51. One or more, such as two cams or eccentric members 54 are disposed in the chamber 52 of the housing 51, and include a bore 55 formed therein, for attaching or securing to the spindle 21 of the fan device 22, and to allow the eccentric members 54 to be rotated or driven by the spindle 21 of the fan device 22.

Two links 56 are slidably received in the chamber 52 of the housing 51, and each includes an opening 57 formed therein for rotatably receiving the eccentric members 54 respectively, and two bearings 58 are also engaged in the openings 57 of the links 56 and engaged between the links 56 and the eccentric members 54 respectively, for rotatably engaging the eccentric members 54 within the openings 57 of the links 56 respectively, and for allowing the links 56 to be moved in reciprocating action by the eccentric members 54.

Figure 5:
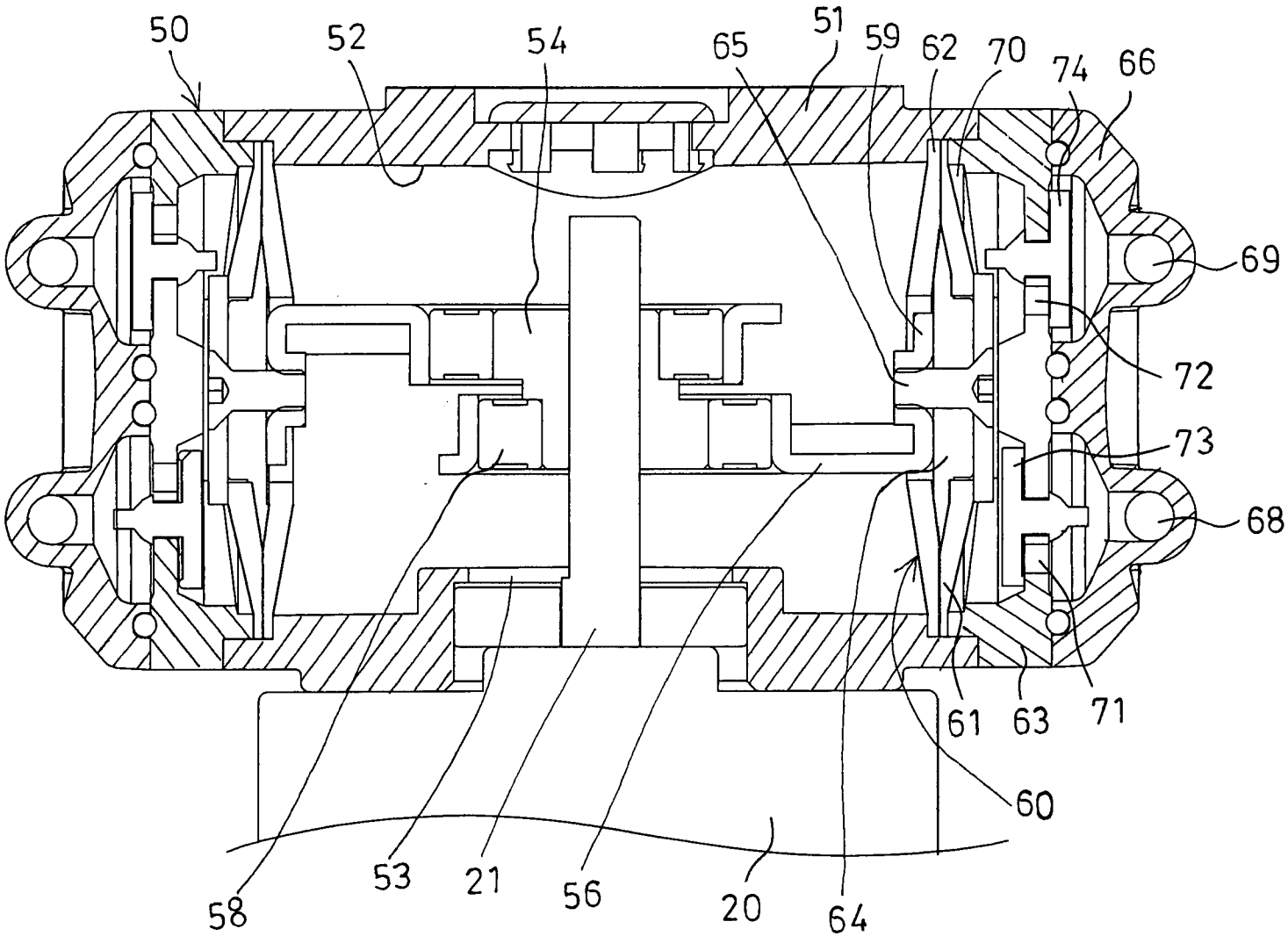
FIG. 5 is an enlarged partial cross sectional view taken along lines 5-5 of FIG. 3.
Figure 6:
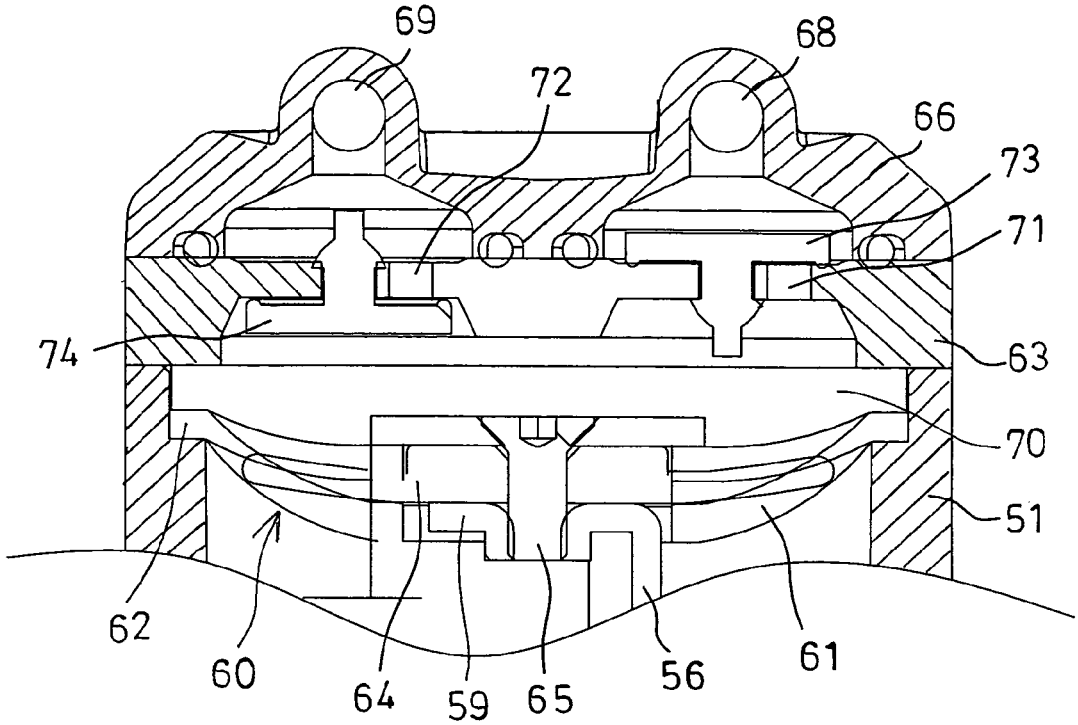
FIGS. 6, 7 are enlarged partial cross sectional views illustrating the operation of the water draining device of the air conditioner.
Figure 7:
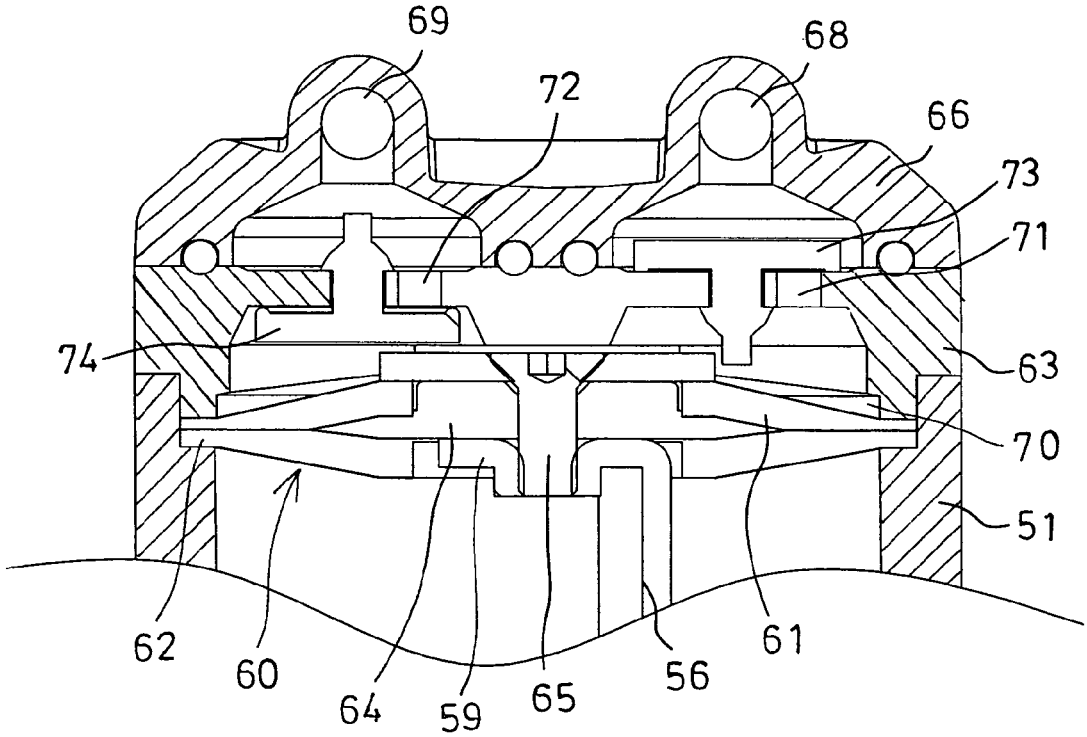

One or more, such as two membrane devices 60 are disposed in or attached to two sides of the housing 51, and each includes two membrane members 61 superposed with each other and having an outer peripheral portion 62 secured or clamped to the side portions of the housing 51 with a board 63, i.e., the outer peripheral portions 62 of the membrane members 61 are secured or clamped between the housing 51 and the boards 63, to form a compartment 70 between each of the boards 63 and the respective membrane device 60 (FIGS. 5-7). The boards 63 may also be formed integral with or solidly formed onto the housing 51.

A follower 64 is disposed between the membrane members 61, and secured or coupled to the other end or the free end portions 59 of the links 56 with such as fasteners 65, to allow the membrane members 61 of the membrane devices 60 to be actuated or operated by the links 56 respectively. Two caps 66 are secured to the side portions of the housing 51 with such as fasteners 67, and each includes an inlet 68 coupled to the hoses 35 of the indoor devices 3, for receiving the water collected from the indoor devices 3, and an outlet 69 coupled to the collecting reservoir 13 to collect the water within the collecting reservoir 13, or to direct the water to flow out of the outdoor device 1. The caps 66 may also be formed integral with or solidly formed onto the housing 51 and/or the boards 63 respectively.

As shown in FIGS. 4-7, the boards 63 each includes one or more orifices 71 formed therein and communicating between the compartment 70 of the boards 63 or of the housing 51 and the inlet 68 of the cap 66, and each includes one or more apertures 72 formed therein and communicating between the compartment 70 of the boards 63 or of the housing 51 and the outlet 69 of the cap 66. The water draining device 50 further includes two check valves 73, 74 attached to each of the boards 63, to control or to limit the water to flow from the inlet 68 of the cap 66 into the compartment 70 of the board 63 or of the housing 51, and then to flow from the compartment 70 to the outlet 69 of the cap 66.

In operation, as shown in FIGS. 5-7, the membrane devices 60 may be actuated or operated in reciprocating action by the eccentric members 54 via the links 56 respectively, in order to draw or to pump the water to flow from the hoses 35 of the indoor devices 3 into the inlet 68 of the cap 66, and then into the compartment 70 of the board 63 or of the housing 51, and then to force or to pump the water to flow from the compartment 70 to the outlet 69 of the cap 66, and then to the collecting reservoir 13, to allow the water to be collected within the collecting reservoir 13, and/or then to be directed or discharged out of the collecting reservoir 13.

Figure 8:
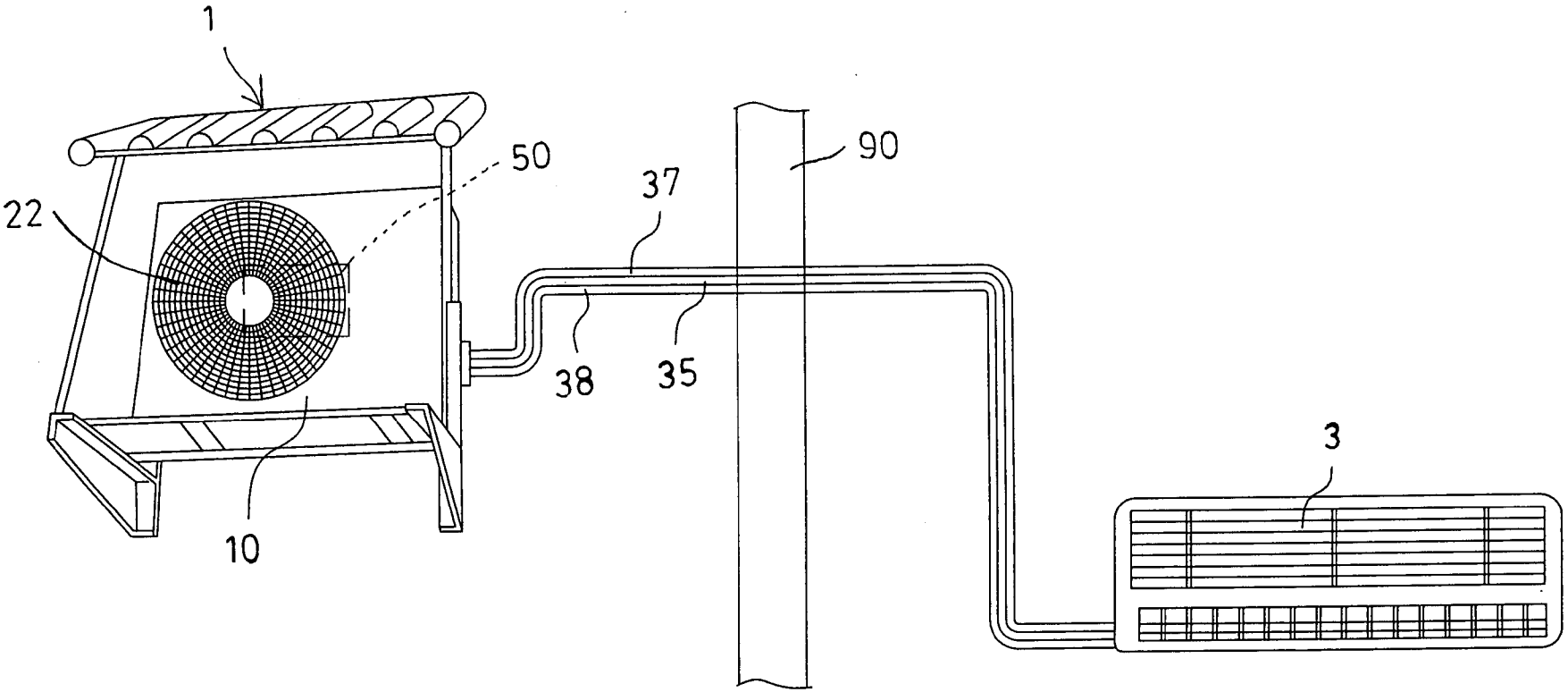
FIG. 8 is a perspective view illustrating the other arrangement of the air conditioner.
Figure 9:
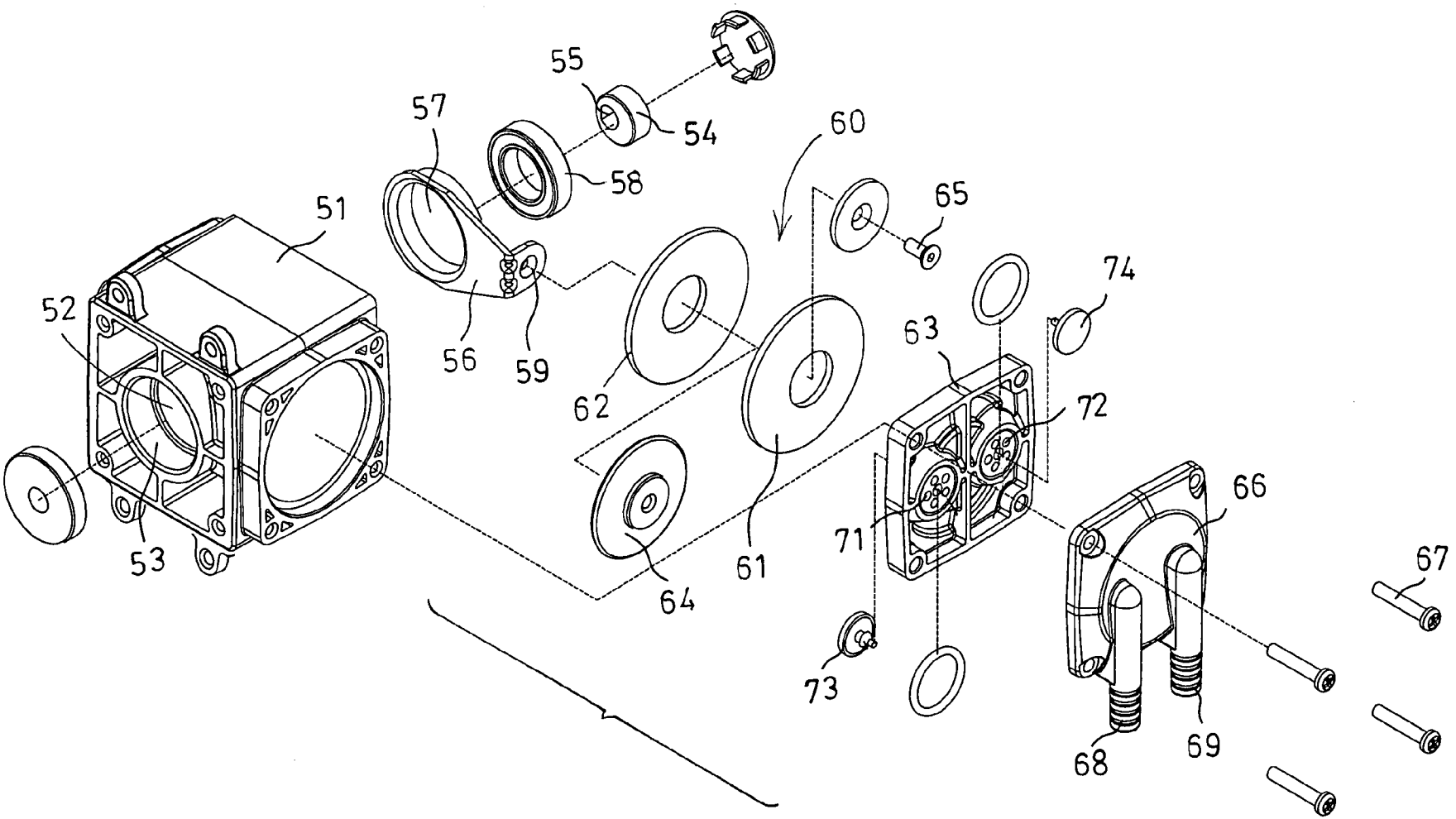
FIG. 9 is a partial exploded view illustrating the water draining device of the air conditioner as shown in FIG. 8.
Figure 10:
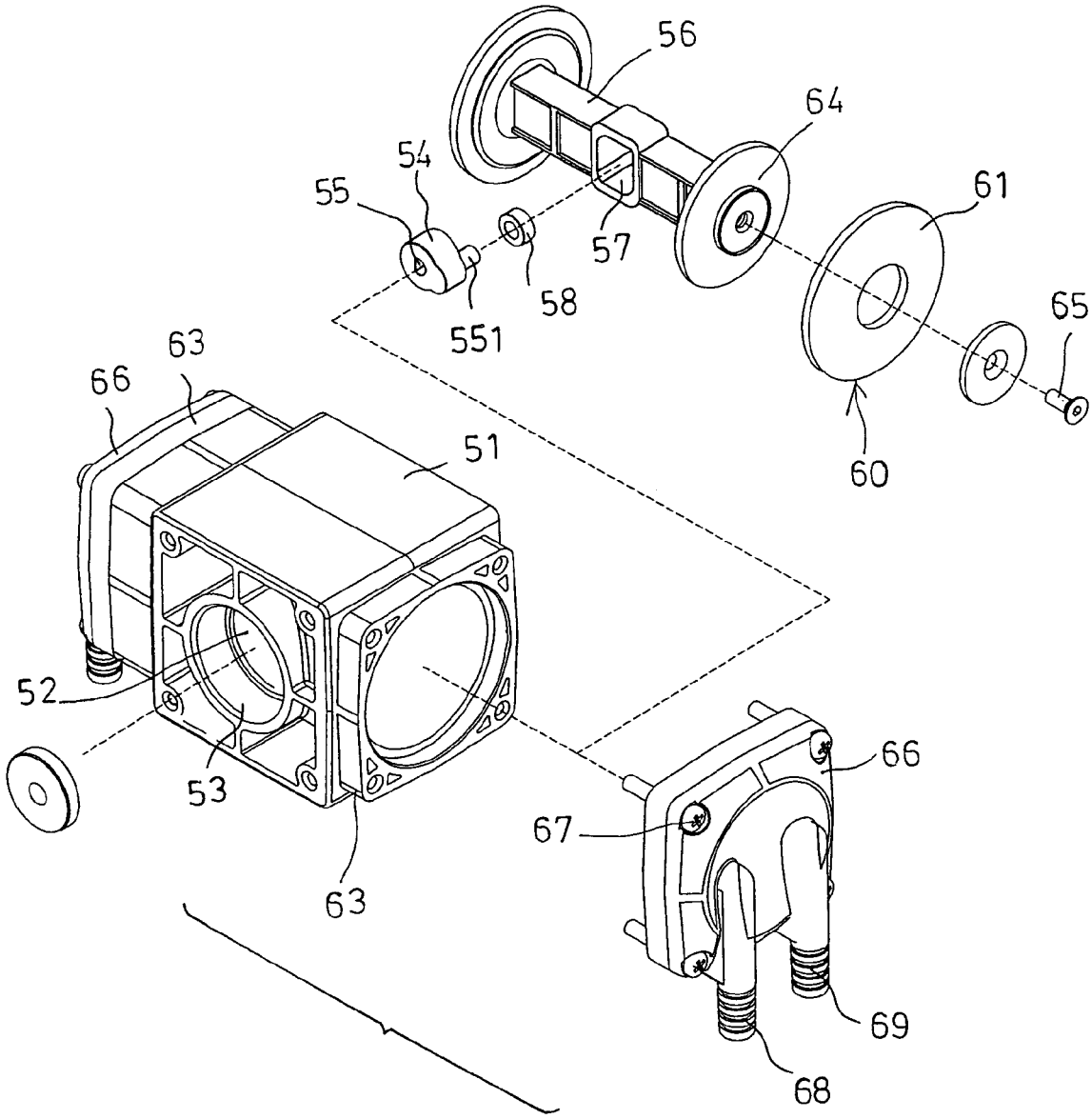
FIG. 10 is another partial exploded view similar to FIG. 9, illustrating the further arrangement of the water draining device of the air conditioner.

Referring next to FIGS. 8-9, the air conditioner in accordance with the present invention may include only one indoor device 3 provided and coupled to the receptacle 10 of the outdoor device 1. Referring next to FIG. 10, alternatively, the two links 56 may be formed integral with each other, and the followers 64 of the membrane devices 60 may also be attached to or formed integral with the links 56, for allowing the two membrane devices 60 to be coupled together. A single eccentric member 54 may be attached or secured to the spindle 21 of the fan device 22, and includes an off-center pin 551 extended therefrom, for rotatably engaging into the opening 57 of the links 56 with the bearing 58, to allow the two membrane devices 60 to be operated or actuated by the spindle 21 of the fan device 22.

Accordingly, the air conditioner includes a draining device for draining or removing water from indoor devices and for preventing water from dropping into family buildings from the indoor devices.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air conditioner comprising:

an indoor device including a water draining hose for receiving water generated in said indoor device, an outdoor device including a fan device having a spindle, and a water draining device coupled to said spindle of said fan device, and coupled to said hose of said indoor device, to draw the water out of said hose of said indoor device, and to prevent the water from dropping from said indoor device.

2. The air conditioner as claimed in claim 1, wherein said water draining device includes a housing having a cap attached thereto, said cap includes an inlet coupled to said hose of said indoor device, and an outlet for discharging the water.

3. The air conditioner as claimed in claim 2, wherein said housing includes a compartment formed therein and communicating with said inlet and said outlet of said cap, and two check valves disposed between said compartment of said housing and said cap, to control the water to flow from said hose of said indoor device into said inlet of said cap, and then into said compartment of said housing, and then to force the water to flow from said compartment to said outlet of said cap.

4. The air conditioner as claimed in claim 3, wherein said water draining device includes a board secured between said housing and said cap, and having at least one orifice formed therein and communicating between said compartment and said inlet of said cap, and having at least one aperture formed therein and communicating between said compartment and said outlet of said cap, said check valves are attached to said board.

5. The air conditioner as claimed in claim 2, wherein said water draining device includes a collecting reservoir coupled to said outlet of said cap, to receive and to collect the water from said water draining device.

6. The air conditioner as claimed in claim 5, wherein said water draining device includes a housing having a chamber formed therein, an eccentric member disposed in said chamber of said housing and having a bore formed therein for attaching to said spindle of said fan device, and to allow said eccentric member to be rotated and driven by said spindle of said fan device.

7. The air conditioner as claimed in claim 6, wherein said water draining device includes a membrane device attached to said housing, and coupled to said eccentric member with a link, to allow said membrane device to be operated by said spindle of said fan device.

8. The air conditioner as claimed in claim 7, wherein said membrane device includes two membrane members superposed with each other and having an outer peripheral portion secured to said housing, and a follower disposed between said membrane members, and coupled to said link, to allow said membrane members of said membrane device to be actuated by said link.

9. The air conditioner as claimed in claim 7, wherein said link includes an opening formed therein for rotatably receiving said eccentric member, and a bearing engaged in said opening of said link and engaged between said link and said eccentric member, for rotatably engaging said eccentric member within said opening of said link.

10. The air conditioner as claimed in claim 1, wherein said indoor device includes a container, and a tray disposed in said container, to collect water, said tray includes an outlet coupled to said hose via a tube.

11. The air conditioner as claimed in claim 10, wherein said indoor device includes a piping disposed in said container, and arranged above said tray, to allow said tray to collect the water from said piping.

12. The air conditioner as claimed in claim 10, wherein said indoor device includes a controller disposed between said tube and said hose, to control the water to flow from said indoor device to said water draining device.

* * * * *